US007603077B2

(12) United States Patent
Onomatsu et al.

(10) Patent No.: US 7,603,077 B2
(45) Date of Patent: Oct. 13, 2009

(54) BROADCAST RECEIVER WITH AUTOMATIC CHANNEL SCANNING

(75) Inventors: Takehiro Onomatsu, Osaka (JP); Shusuke Narita, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 469 days.

(21) Appl. No.: 11/166,047

(22) Filed: Jun. 24, 2005

(65) Prior Publication Data

US 2006/0003690 A1 Jan. 5, 2006

(30) Foreign Application Priority Data

Jun. 25, 2004 (JP) ..... P2004-188672

(51) Int. Cl.
*H04H 20/74* (2008.01)

(52) U.S. Cl. ..... 455/3.02; 455/3.01; 455/3.03; 455/179.1; 455/181.1; 725/63; 725/68; 725/72; 342/74; 342/75; 342/76

(58) Field of Classification Search ..... 455/3.01–3.06, 455/63.4, 179.1, 181.1, 184.1, 185.1; 725/63, 725/68, 72, 151; 342/74–76, 148, 154, 157, 342/158, 354, 359, 367, 368, 371, 373, 374
See application file for complete search history.

(56) References Cited

U.S. PATENT DOCUMENTS 4,801,940 A * 1/1989 Ma et al. ..... 342/359
7,312,750 B2 * 12/2007 Mao et al. ..... 342/377

FOREIGN PATENT DOCUMENTS

| | | | |
|---|---|---|---|
| JP | 56-17536 | | 2/1981 |
| JP | 62-069733 | * | 3/1987 |
| JP | 62-69734 | | 3/1987 |
| JP | 5-232205 | | 9/1993 |
| JP | 11-298226 | * | 10/1999 |
| JP | 2001-160773 | | 6/2001 |
| JP | 2004-173062 | | 6/2004 |

OTHER PUBLICATIONS

Translation of 11-298226.*
Translation of 62-069733.*
Patent Abstracts of Japan, Publication No. 2001-160773, Publication Date Jun. 12, 2001, 1 page.

(Continued)

*Primary Examiner*—Edward Urban
*Assistant Examiner*—Fayyaz Alam
(74) *Attorney, Agent, or Firm*—Osha • Liang LLP

(57) ABSTRACT

A broadcast receiver includes a smart antenna, a tuner for extracting a signal of a predetermined channel from airwaves received by the smart antenna, a signal processing unit for processing the signal extracted by this tuner, and a control unit for controlling the smart antenna. The control unit detects a receivable direction by performing automatic scanning for each of the channels with respect to each of the directions of the smart antenna, and when the receivable direction is first detected during execution of automatic scanning for a certain channel, the automatic scanning is stopped at a point in time of the detection and transition to automatic scanning for the next channel is made.

1 Claim, 12 Drawing Sheets

OTHER PUBLICATIONS

Patent Abstracts of Japan, Publication No. 05-232205, Publication Date Sep. 7, 1993, 1 page.

Patent Abstracts of Japan, Publication No. 56-017536, Publication Date Feb. 19, 1981 , 1 page.

Japanese Office Action for Japanese patent application No. 2004-188672, mailed May 7, 2009, and English translation thereof, 4 pages.

* cited by examiner

| CHANNEL | DIRECTION |
|---|---|
| 2 | 7 |
| 3 | 9 |
| 6 | 5 |
| 8 | 9 |
| 10 | 9 |

| CHANNEL | DIRECTION |
|---|---|
| 2 | 7 |
| 3 | 9 |
| 6 | 5 |
| 8 | 9 |
| 10 | 9 |
| 12 | 13 |

| CHANNEL | DIRECTION | RANKING |
|---|---|---|
| 2 | 7 | 2 |
| 3 | 9 | 1 |
| 6 | 13 | 3 |
| 8 | 9 | 1 |
| 10 | 9 | 1 |
| 12 | 7 | 2 |
| 13 | 5 | 3 |

BROADCAST RECEIVER WITH AUTOMATIC CHANNEL SCANNING

BACKGROUND OF THE INVENTION

1. Field of the Invention

The present invention relates to a broadcast receiver for receiving airwaves of a predetermined channel sent from plural broadcast stations by a directional switching antenna.

2. Description of the Related Art

In Japan, airwaves of television broadcasts etc. are generally sent from a base station of one place. As a result of that, almost all the airwaves sent by plural broadcast stations can be received by directing an antenna for broadcast receiving to the base station and fixing the antenna to a roof or a veranda, etc. of a house and connecting the antenna to a broadcast receiver through a cable. On the other hand, for example, in the U.S.A., airwaves are individually sent from plural broadcast stations, respectively. As a result of that, when an antenna is directed at one place and is fixed, airwaves of the broadcast station located in a direction in which the antenna is directed can be received, but airwaves of the broadcast station located in a direction in which the antenna is not directed cannot be received.

Therefore, it is necessary to switch directivity of an antenna in plural directions in order to receive radio waves from plural broadcast stations located in different bearings by one antenna. An antenna capable of switching such directivity (hereinafter called "a directional switching antenna") is described in, for example, JP-A-2001-160773 (Paragraphs 0014 to 0017, FIG. 1), JP-A-5-232205 (Paragraphs 0009 to 0018, FIG. 4) and JP-A-56-17536 (Page 5, Line 5 of the upper left field to Page 5, Line 12 of the lower right field), mentioned below. The directional switching antenna is constructed of plural antenna elements and phase shifters, etc. corresponding to each of the antenna elements, and directivity is electrically varied by adjusting phases of signals received in each of the antenna elements by each of the phase shifters and combining the phases. For example, in a smart antenna which is one example of the directional switching antenna, it is stipulated that directivity should be switched in 16 directions.

In the case of using such a directional switching antenna, airwaves from each of the broadcast stations can be received by sending a control signal from a broadcast receiver to the antenna and switching directivity of the antenna in a predetermined direction. As a result of this, a user can receive almost all the airwaves sent from plural broadcast stations interspersed even when the directional switching antenna is fixed and attached to a roof etc. of a house.

Control methods of the directional switching antenna are shown in JP-A-2001-160773, JP-A-5-232205 and JP-A-56-17536. In JP-A-2001-160773, it is constructed so that a load on a phase shifter is reduced to decrease a failure rate by performing control in which frequency of a beam oriented direction in which a received signal becomes a maximum level is counted and the beam oriented direction is fixed in a direction with the largest frequency to conduct communication and when the communication is blocked, the beam oriented direction is switched in a direction with the second largest frequency to conduct communication and when the communication is blocked, the beam oriented direction is switched in a direction with the third largest frequency. In JP-A-5-232205, it is constructed so that when a receiving level in the present oriented direction becomes lower than a reference value, the oriented direction is respectively changed by one step clockwise and counterclockwise and when a receiving level in the oriented direction after the change is higher than the receiving level in the present oriented direction, its direction is set as a new oriented direction and thereby a satellite can be tracked with high accuracy. In JP-A-56-17536, it is constructed so that in the case of switching an oriented direction, directivity is periodically changed by a small amount and a switching direction is decided based on a change state of a received signal at that time and thereby a received signal level is prevented from dropping in a transition process of the oriented direction and stable reception can be performed.

The broadcast receiver for receiving airwaves by the directional switching antenna as described above is provided with a function of automatic scanning so that at the time of selecting a channel, a direction in which airwaves of its channel can be received with the highest sensitivity is retrieved and directivity of the antenna can be adjusted to its direction. In this automatic scanning, with respect to each of the channels, the directivity of the antenna is sequentially switched and a level of a received signal in each of the directions is detected. Then, when the level of the received signal is a threshold value or more, it is determined that its direction is a receivable direction in the corresponding channel, and further a direction with the largest reception level (that is, high reception sensitivity) among the receivable directions is decided as an optimum direction in its channel. Then, airwaves of its channel can be received in the best state by electrically controlling the antenna so that the directivity of the antenna becomes the optimum direction.

FIG. 12 is a diagram describing a method of automatic scanning at the time of channel selection. Here, the case of a smart antenna capable of switching directivity in 16 directions is taken as an example. Numeric characters 0 to 15 in the drawing indicate numbers of the directions. As shown in FIG. 12, when one channel is selected, for example, scanning is started from the direction 0 and while scanning is sequentially performed counterclockwise, levels of received signals in the respective directions are detected and it is determined whether or not the levels are a threshold value or more. This action is called seek processing. This processing is performed with respect to all the directions ranging from the direction 0 to the direction 15 and capability or incapability of reception is determined every each of the directions. Here, the directions 9, 10, 11 and 12 are in states capable of reception. Then, at a point in time when the scanning is performed to the direction 15 and the seek processing is ended, the direction with the largest reception level among the receivable directions, that is, the direction with the highest reception sensitivity is decided as an optimum direction in its channel. Here, the direction 11 is in a state of the optimum direction.

By the way, in a broadcast receiver, a preset function for setting channels capable of being viewed in a use region of the receiving apparatus is required like a general television image receiving apparatus. Then, in order to automatically make this presetting, a function of automatic scanning for sequentially switching directivity of an antenna and retrieving receivable channels is required.

However, when the same algorithm as that of the automatic scanning at the time of normal channel selection as described above is used as algorithm of the automatic scanning in the case of presetting a channel, seek processing is performed over all the directions of the antenna every each of the channels and processing for detecting the optimum direction from among receivable directions is performed, so that there is a problem that it takes time to complete the automatic scanning for all the channels and waiting time of a user becomes long.

The automatic scanning at the time of presetting a channel is originally processing performed to retrieve receivable channels, and seek processing for performing detection to the optimum direction is not required in the case of only retrieving the receivable channels. The invention has been implemented from such a standpoint, and an object of the invention is to achieve a speedup in automatic scanning at the time of presetting a channel in a broadcast receiver for receiving airwaves by a directional switching antenna.

SUMMARY OF THE INVENTION

A broadcast receiver according to the invention is a receiving apparatus for receiving airwaves by a directional switching antenna capable of switching directivity in plural directions, and includes an automatic scanning function of retrieving a receivable channel, and is constructed so that when a receivable direction is first detected during execution of automatic scanning for a certain channel, the automatic scanning is stopped at a point in time of the detection and transition to automatic scanning for the next channel is made.

In the invention, at a point in time when a receivable direction is first detected, the automatic scanning is stopped and automatic scanning for the next channel is executed. As a result of this, a speedup in the automatic scanning can be achieved by extracting a receivable channel and ensuring a presetting function and also omitting retrieval processing of an optimum direction unnecessary.

In the invention, a smart antenna can be used as a typical directional switching antenna. Five embodiments using the smart antenna are disclosed in the embodiments described below.

In a first embodiment, a broadcast receiver includes a tuner for extracting a signal of a predetermined channel from airwaves received by a smart antenna, a signal processing unit for processing the signal extracted by this tuner, and a control unit for controlling the smart antenna. The control unit performs automatic scanning for each of the channels with respect to each of the directions of the smart antenna and detects a receivable direction. Also, when the control unit first detects the receivable direction during execution of automatic scanning for a certain channel, the automatic scanning is stopped at a point in time of the detection and transition to automatic scanning for the next channel is made. As a result of this, a speedup in the automatic scanning can be achieved.

In a second embodiment, a broadcast receiver includes the tuner, the signal processing unit and the control unit similar to those of the first embodiment. The second embodiment is characterized in that before automatic scanning for a certain channel is executed, the control unit examines a receivable direction detected for the previous channel of the channel and starts the automatic scanning using its direction as an initial point. In the case of being constructed thus, automatic scanning is started from a direction with the possibility of reception, so that time necessary to find the receivable direction can be reduced to achieve a more speedup in the automatic scanning.

In a third embodiment, a broadcast receiver includes the tuner, the signal processing unit and the control unit similar to those of the first embodiment. The third embodiment is characterized in that before automatic scanning for a certain channel is executed, the control unit examines the most direction of receivable directions detected in the past and starts the automatic scanning using its direction as an initial point. In the case of being constructed thus, automatic scanning is started from a direction with a high probability capable of reception, so that time necessary to find the receivable direction can further be reduced to achieve a still more speedup in the automatic scanning.

In a fourth embodiment, a broadcast receiver includes the tuner, the signal processing unit and the control unit similar to those of the first embodiment. The fourth embodiment is characterized in that before automatic scanning for a certain channel is executed, the control unit examines the most direction of receivable directions detected in the past and also examines whether there are more receivable directions in either clockwise direction or counterclockwise direction with respect to its direction and decides a scanning direction and starts the automatic scanning in the scanning direction using the most direction as an initial point. In the case of being constructed thus, automatic scanning is started from a direction with a high probability capable of reception and the scanning is performed in a direction with a high probability capable of reception, so that time necessary to find the receivable direction can further be reduced to achieve a still more speedup in the automatic scanning.

In a fifth embodiment, a broadcast receiver includes the tuner, the signal processing unit and the control unit similar to those of the first embodiment. The fifth embodiment is characterized in that before automatic scanning for a certain channel is executed, the control unit ranks receivable directions detected in the past according to detection frequency and starts the automatic scanning using the direction with the first ranking as an initial point and subsequently executes the automatic scanning in a predetermined direction according to the ranked order. In the case of being constructed thus, automatic scanning is performed in each of the directions in order of higher probability capable of reception, so that time necessary to find the receivable direction can further be reduced to achieve a still more speedup in the automatic scanning.

According to the invention, retrieval processing in an optimum direction at the time of presetting a channel becomes unnecessary and thereby a speedup in automatic scanning can be achieved and waiting time of a user can be reduced.

DETAILED DESCRIPTION OF THE INVENTION

Figure 1:
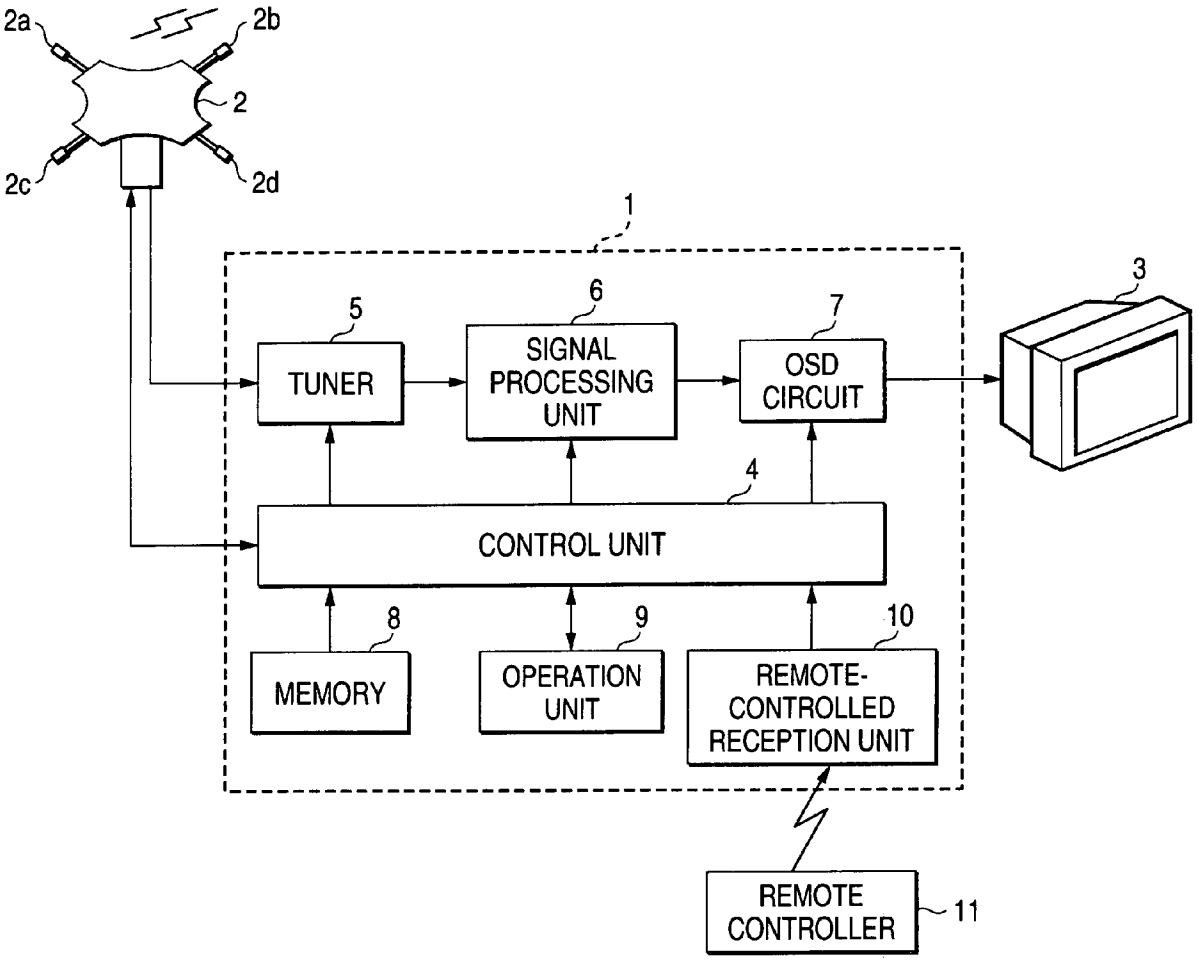
FIG. 1 is a diagram showing a receiving system using a broadcast receiver according to the invention.

FIG. 1 is a diagram showing a receiving system of a television broadcast using a broadcast receiver according to the invention. In FIG. 1, numeral 1 is a broadcast receiver; and numeral 2 is a smart antenna, and numeral 3 is a television image receiving apparatus (hereinafter called "TV set"). The broadcast receiver 1 and the TV set 3 are installed inside a house of a general home and are connected by a cable. The smart antenna 2 is attached and fixed to a roof or a veranda of the house and is connected to the broadcast receiver 1 by a cable.

The smart antenna 2 includes four antenna elements 2*a* to 2*d*, and phase shifters, combination devices and control circuits, etc. (the portions other than the antenna elements 2*a* to 2*d* are omitted in the drawing) disposed corresponding to each of the antenna elements 2*a* to 2*d*, and directivity is electrically switched in 16 directions by adjusting phases of signals received by each of the antenna elements 2*a* to 2*d* through each of the phase shifters and combining the signals after the adjustment through the combination devices. Incidentally, the 16 directions mean each of the directions in which the circumference (360°) of the smart antenna 2 is divided into 16 pieces, and each of the directions is shown by numbers of 0 to 15 (for example, see FIG. 2). The broadcast receiver 1 receives television airwaves sent from plural broadcast stations interspersed in the periphery of the house by controlling the smart antenna 2 and switching directivity of the smart antenna 2. The smart antenna 2 constructs one embodiment of a directional switching antenna in the invention.

Numeral 4 is a control unit made of a CPU, ROM or RAM, etc., and controls each part of the broadcast receiver 1. Data and programs for control are stored in the ROM of the control unit 4, and data for control is readably and writably stored in the RAM. This control unit 4 detects receivable directions by performing automatic scanning with respect to each of the directions of the smart antenna 2 as described below.

Numeral 5 is a tuner, and extracts a signal of a predetermined channel from airwaves received by the smart antenna 2. Numeral 6 is a signal processing unit, and processes the signal extracted by the tuner 5 and generates a reproduction video signal and a reproduction sound signal. Numeral 7 is an OSD (On Screen Display), circuit, and superimposes image data outputted from the control unit 4 on the reproduction video signal outputted from the signal processing unit 6 and performs on-screen display on a screen of a monitor of the TV set 3. The TV set 3 displays video on the monitor based on the reproduction video signal outputted from the signal processing unit 6 and also outputs sound from a speaker based on the reproduction sound signal outputted from the signal processing unit 6 (illustration of a sound system is omitted in FIG. 1).

Numeral 8 is nonvolatile memory, and numeral 9 is an operation unit including various keys such as a channel key or a power source key, and numeral 10 is a remote-controlled reception unit for receiving a signal from a remote controller 11. The remote controller 11 includes various keys such as a channel key, a menu key and a cross key.

In the configuration described above, when a user turns on a power source of the broadcast receiver 1 after the broadcast receiver 1 is connected to the smart antenna 2, the control unit 4 presets a channel (initialization). Incidentally, when the user operates the remote controller 11 and instructs presetting, the control unit 4 also presets a channel. In the presetting of the channel, channel numbers and numbers of receivable directions in the channels are sequentially recorded in the memory 8. Details of this presetting action will be described below. Then, when presettings of all the channels are completed, a channel presetting table in which the channel numbers are associated with the direction numbers is created in a predetermined region of the memory 8.

The creation of the channel presetting table means that almost all the airwaves sent from the plural broadcast stations interspersed in the periphery of the house can be received to set receivable directions of the antenna to the broadcast receiver 1 every channel number. As a result of this, when the user operates the remote controller 11 and switches a channel after the creation of the table, the control unit 4 reads a direction capable of receiving airwaves of the channel of a switching destination out of the table and switches directivity of the smart antenna 2 in the direction shown by the number and thereby the airwaves of the same channel number can be received immediately. Then, the received airwaves are processed by the tuner 5 and the signal processing unit 6 and immediately, video can be displayed on the TV set 3 and also sound can be outputted. As a result of this, time necessary for the user to be able to view a broadcast of the channel number of the switching destination can be reduced.

Figure 2:
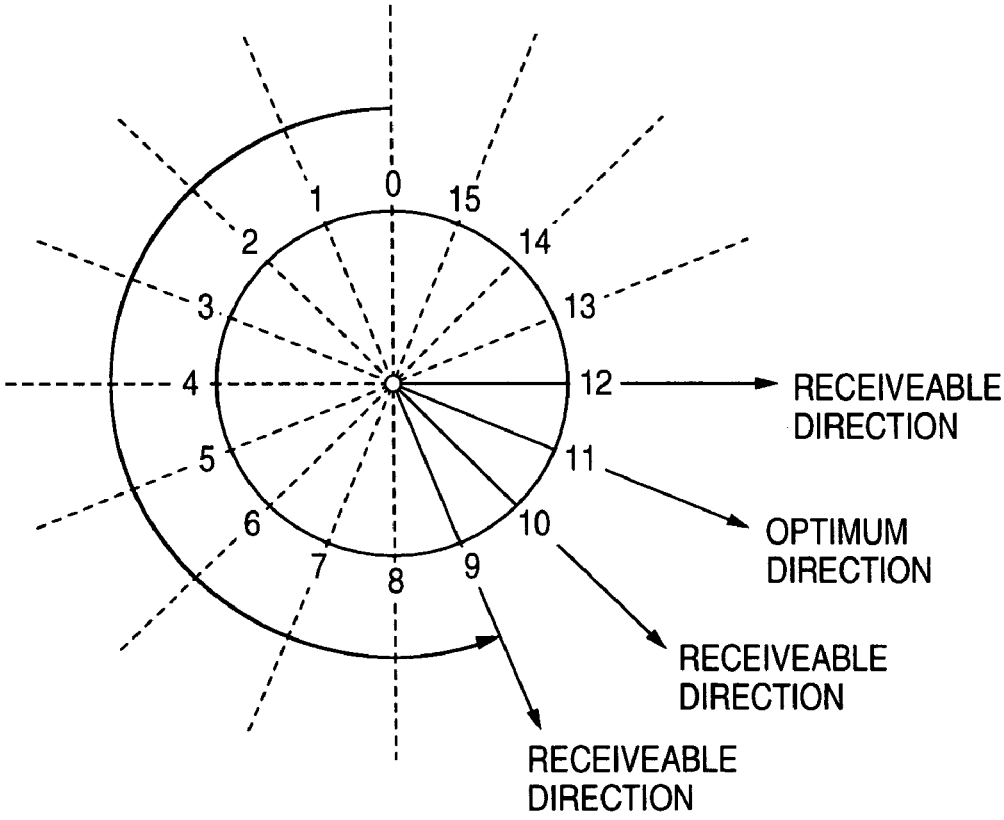
FIG. 2 is a diagram describing an action of a first embodiment.

FIG. 2 is a diagram describing an automatic scanning action at the time of presetting a channel in a first embodiment of the invention. In the present embodiment, seek processing in which automatic scanning is started using a direction 0 as an initial point and while the scanning is sequentially performed in order of 0→1→2→3→4→ . . . counterclockwise, levels of received signals in each of the directions are detected and it is determined whether or not the levels are a threshold value or more is executed. Then, at a point in time when a receivable direction is first detected during execution of automatic scanning for a certain channel (for example, Channel 2), the automatic scanning is stopped and automatic scanning of the next channel (for example, Channel 3) is started.

In an example of FIG. 2, in the direction 0 to a direction 8, levels of received signals were less than the threshold value and the receivable direction was not detected, but the level of the received signal first became the threshold value or more in a direction 9, so that it is decided that the direction 9 is the receivable direction detected first, and at this point in time, the automatic scanning is immediately broken and the seek processing is ended. The direction 9 at this time is associated with a channel number and is recorded in a channel presetting table of the memory 8. Then, automatic scanning of the next channel is again started using the direction 0 as the initial point and the seek processing is performed while sequentially scanning counterclockwise in a manner similar to the case described above. The procedure described above is repeated until the seek processing for all the channels is completed.

Figure 12:
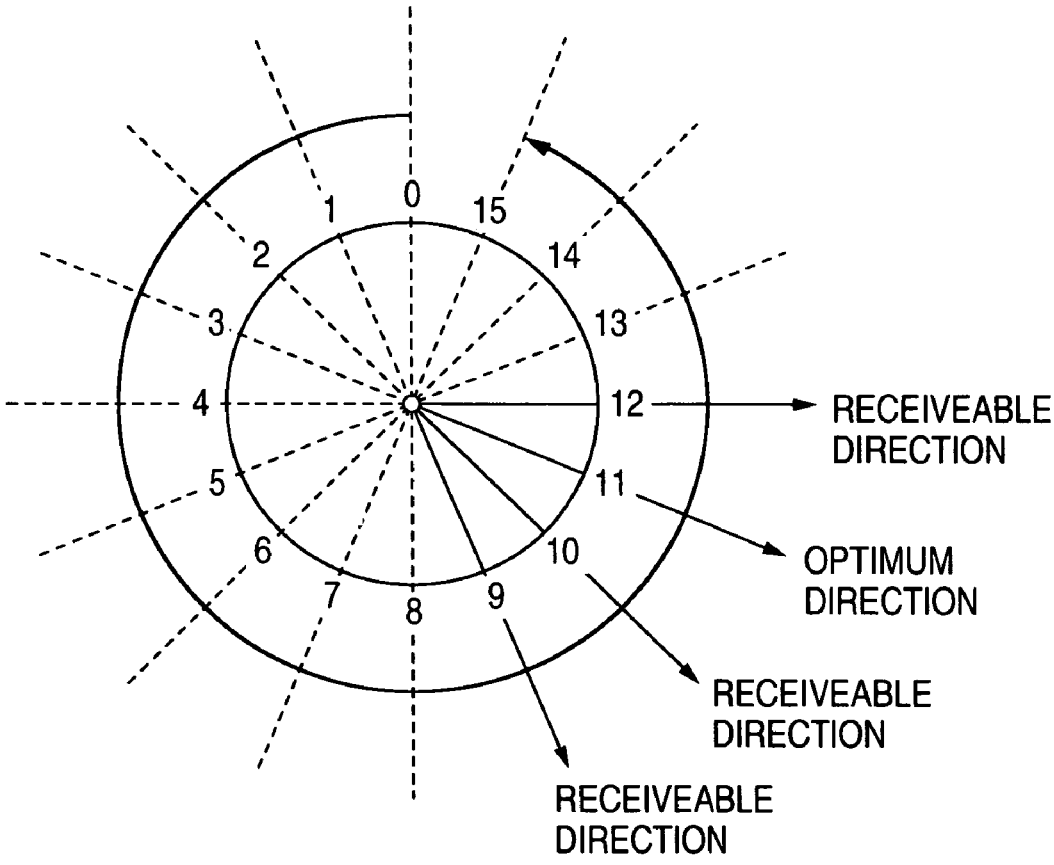
FIG. 12 is a diagram describing a method of automatic scanning at the time of channel selection.

However, the direction 9 detected as the receivable direction in FIG. 2 is not necessarily an optimum direction (direction with the highest reception sensitivity) in its channel. If it is assumed that the seek processing is continued for a direction 10 or later, there is a possibility that, for example, a direction 11 is detected as the optimum direction. Yet, as described above, in the automatic scanning for channel presetting, a receivable channel can have only to be detected, so that it is unnecessary to perform retrieval to the optimum direction. The retrieval of the optimum direction in each of the channels is executed in the case of actually performing a channel selection action of its channel after the end of presetting. The retrieval in this case is executed by, for example, a method as described in FIG. 12. The above description similarly applies to second to fifth embodiments mentioned below.

Figure 3:
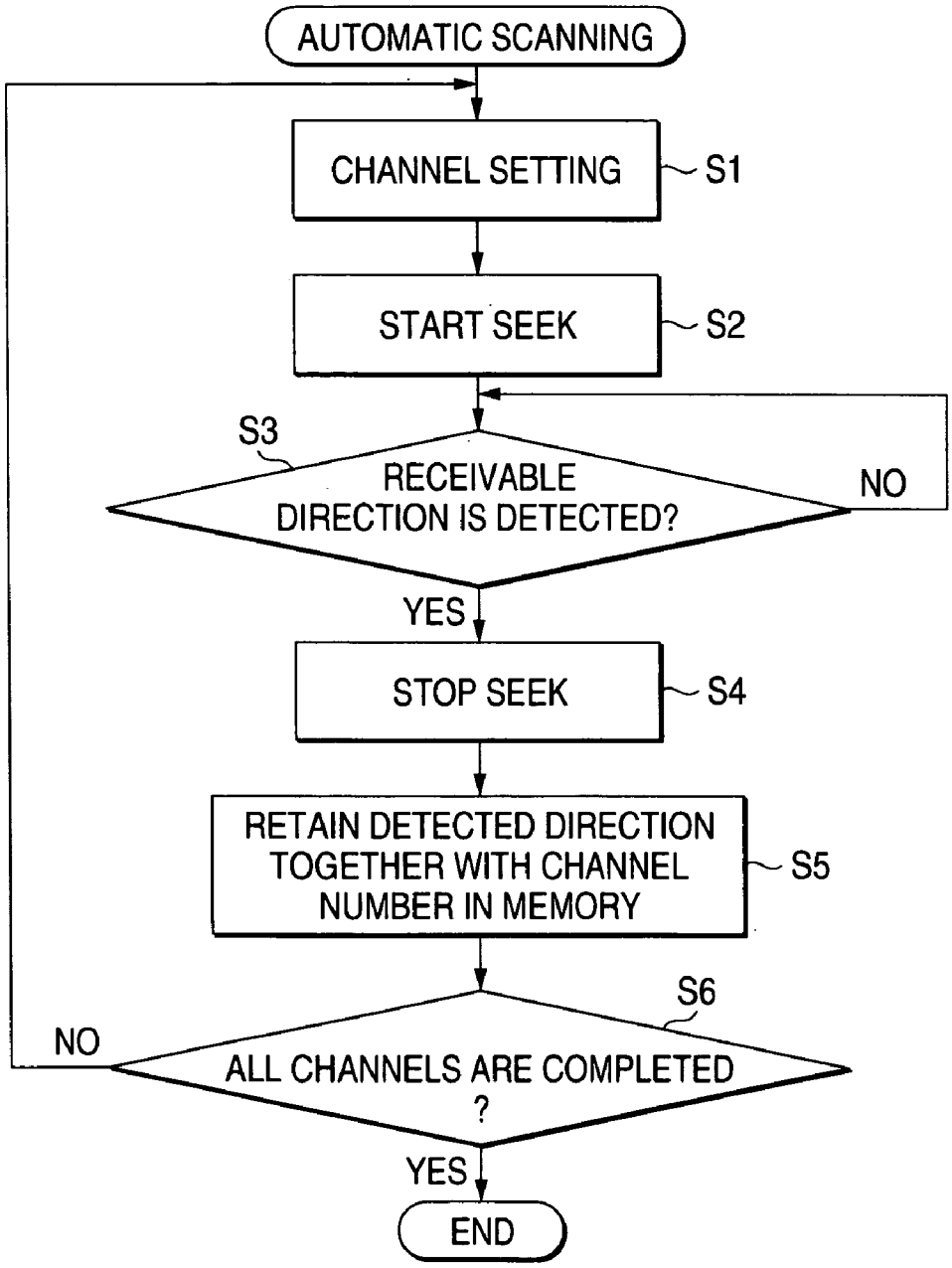
FIG. 3 is a flowchart representing the action of the first embodiment.

FIG. 3 is a flowchart representing the automatic scanning action in the first embodiment. The CPU of the control unit 4 executes this procedure according to a program stored in the ROM. This is similar in the following flowchart. When automatic scanning is started, the control unit 4 makes the smart antenna 2 do setting for a channel searched first (step S1).

That is, the control unit 4 reads a channel number of the first search target out of channel numbers previously registered in a predetermined region of the ROM, and sends this channel number to the smart antenna 2. When the smart antenna 2 receives the channel number, setting for each of the antenna parts is done so that airwaves of a frequency band corresponding to the channel can be received.

Next, the control unit 4 sends a control signal for instructing the smart antenna 2 to sequentially switch directivity counterclockwise from the direction 0 shown in FIG. 2 to the smart antenna 2 in a predetermined cycle and after receiving this control signal, the smart antenna 2 starts seek processing from the direction 0 to the directions 1→2→3→4→ . . . (step S2). After the seek processing is started, the control unit 4 determines whether or not a receivable direction is detected (step S3). This determination is made based on the detection as to whether or not the level of the received signal is the threshold value or more as described already. Then, when the receivable direction is not detected (step S3: NO), the seek processing is continued. On the other hand, when the receivable direction is first detected (step S3: YES), at that point in time, the control unit 4 breaks the automatic scanning and stops the seek processing (step S4). Then, a number of the direction detected at this time is retained in the memory 8 together with a channel number (step S5). Thereafter, it is determined whether or not presettings for all the channels are completed (step S6), and when they are not completed (step S6: NO), the flowchart returns to step S1 and after setting for the next channel is done, the steps S2 to S5 described above are executed and presetting for the next channel is done. When the presettings for all the channels are completed (step S6; YES), the action of automatic scanning is ended. At this point in time, the channel presetting table described above is completed in the memory 8. The direction number recorded in a state of being associated with the channel number in this table represents a direction assumed that airwaves of its channel can be received in subsequent channel selection actions.

According to the first embodiment described above, by extracting a receivable channel, retrieval processing of an optimum direction unnecessary in automatic scanning at the time of presetting is omitted while ensuring a function of presetting a channel, so that the automatic scanning can be performed at high speed and thereby waiting time of a user can be reduced.

Figure 4A:
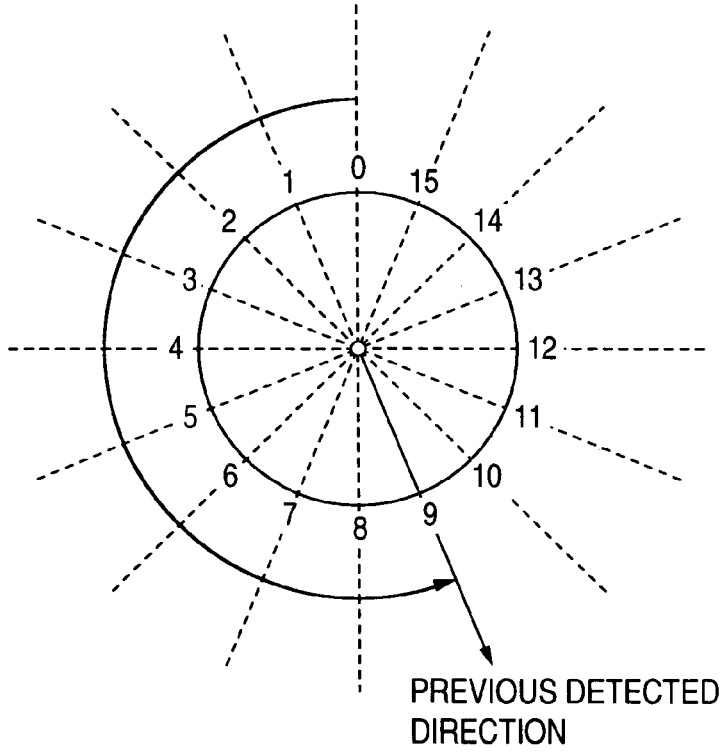
FIGS. 4A and 4B are diagrams describing an action of a second embodiment.
Figure 4B:
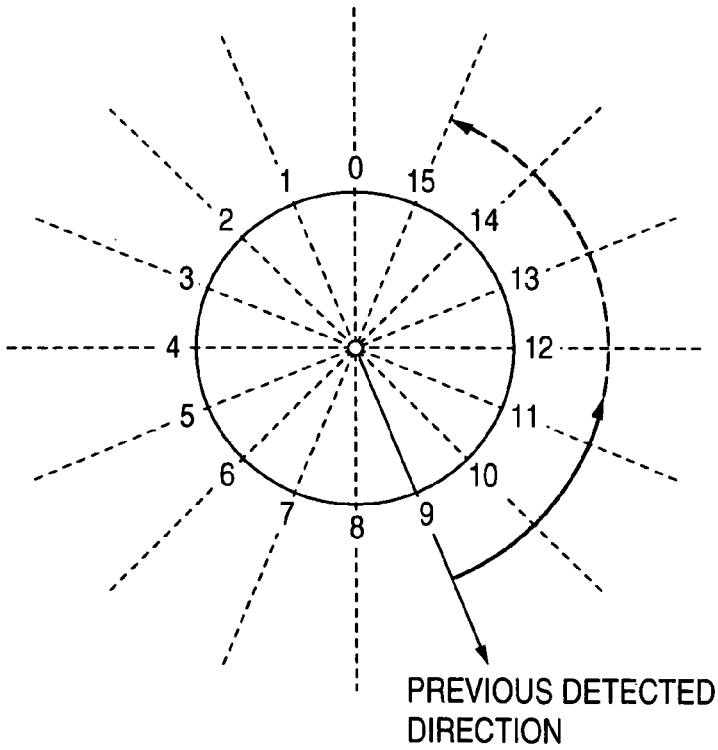

FIGS. 4A and 4B are diagrams describing an automatic scanning action at the time of presetting a channel in a second embodiment of the invention. In the present embodiment, before automatic scanning is executed, a receivable direction detected for the previous channel is examined and the automatic scanning is started using its direction as an initial point. For example, as shown in FIG. 4A, when it is assumed that a direction detected as the receivable direction for the previous channel (for example, Channel 2) was a direction 9, as shown in FIG. 4B, automatic scanning is started for the next channel (for example, Channel 3) using the direction 9 as the initial point and therefrom, seek processing is performed while sequentially scanning in order of 9→10→11→12→ . . . counterclockwise.

In this case, by determining that the direction 9 can be received on the previous channel, there is a possibility that the direction 9 and directions near to the direction 9 are also detected as a receivable direction in this channel, so that time necessary to detect the receivable direction is reduced by starting the automatic scanning using the direction 9 as the initial point.

Then, when it is assumed that, for example, a direction 11 is first detected as a receivable direction during execution of this automatic scanning, in a manner similar to the first embodiment, the automatic scanning is stopped at that point in time and automatic scanning of the next channel (for example, Channel 4) is started using the direction 11 as the initial point. In like manner below, the procedure described above is repeated until the seek processing for all the channels is completed.

Figure 5:
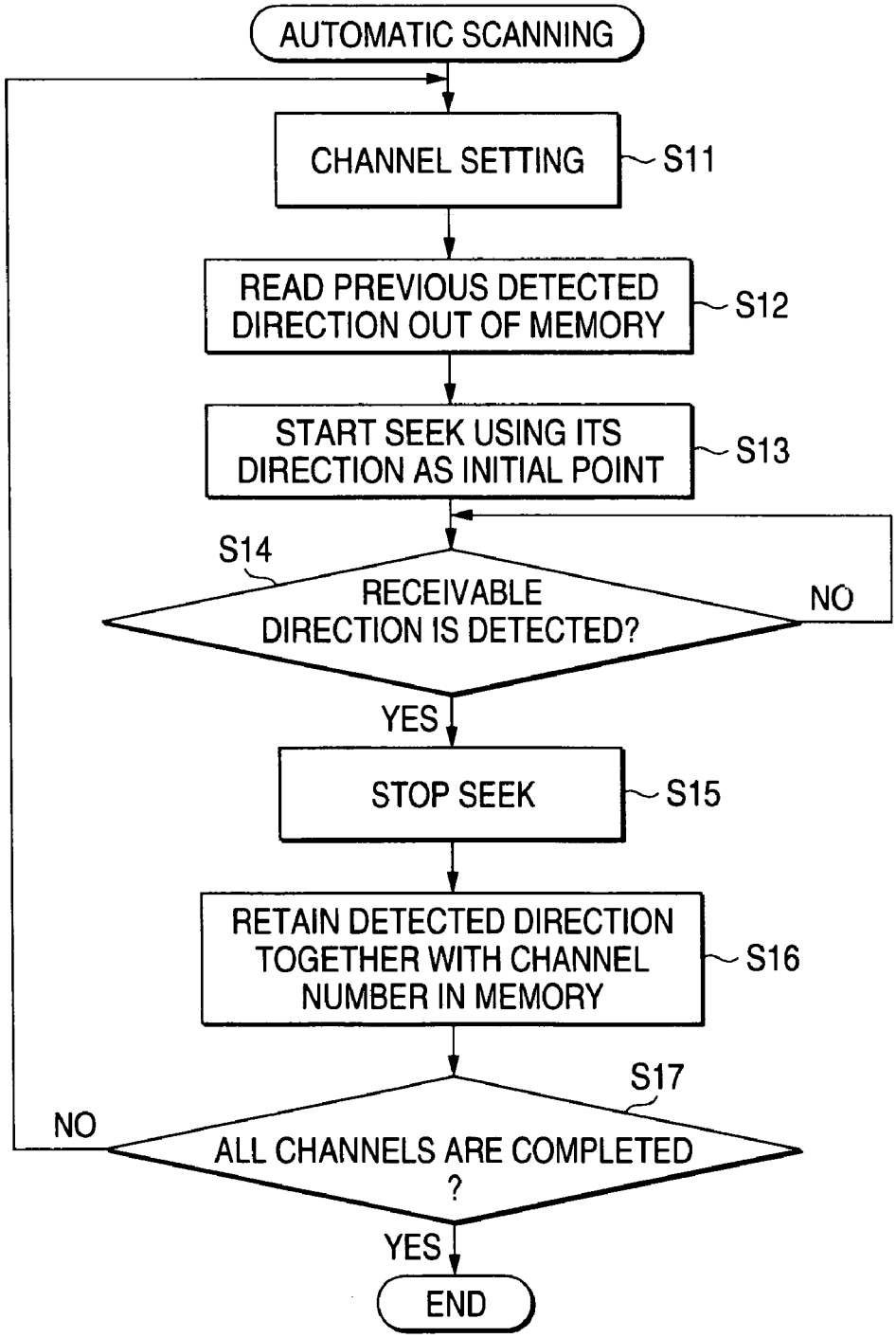
FIG. 5 is a flowchart representing the action of the second embodiment.

FIG. 5 is a flowchart representing the automatic scanning action in the second embodiment. When automatic scanning is started, the control unit 4 makes the smart antenna 2 do setting for a channel searched first (step S11). This detail has been described in step S1 of FIG. 3. Subsequently, the control unit 4 reads out a receivable direction detected in the previous channel with reference to the memory 8 (step S12). With respect to the first channel, the previous data is not present, so that a direction 0 is read out. The control unit 4 sends a control signal for instructing the smart antenna 2 to sequentially switch directivity counterclockwise from the direction read out to the smart antenna 2 in a predetermined cycle and after receiving this control signal, the smart antenna 2 starts seek processing using its direction as an initial point (step S13).

An action after the seek processing is started is similar to that of the case of FIG. 3. That is, the control unit 4 determines whether or not a receivable direction is detected (step S14), and when the receivable direction is not detected (step S14: NO), the seek processing is continued. When the receivable direction is first detected (step S14: YES), at that point in time, the control unit 4 breaks the automatic scanning and stops the seek processing (step S15). Then, a number of the direction detected at this time is retained in the memory 8 together with a channel number (step S16). Thereafter, it is determined whether or not presettings for all the channels are completed (step S17), and when they are not completed (step S17: NO), the flowchart returns to step S11 and after setting for the next channel is done, the steps S12 to S16 described above are executed and presetting for the next channel is done. When the presettings for all the channels are completed (step S17; YES), the action of automatic scanning is ended.

According to the second embodiment described above, automatic scanning is started from a direction with the possibility of reception, so that time necessary to find the receivable direction can be reduced to achieve a more speedup in the automatic scanning.

Figures 6A, 6B:
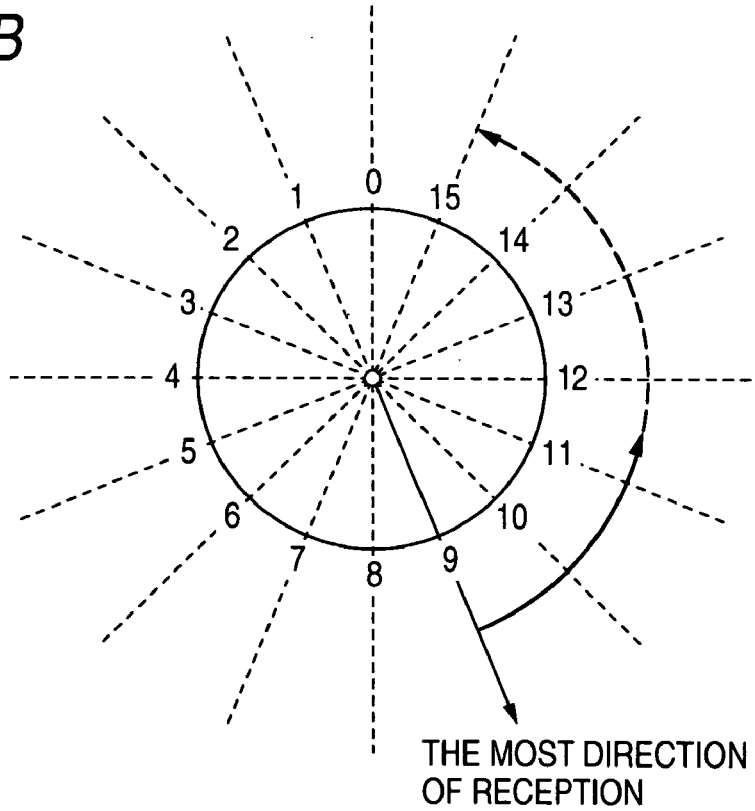
FIGS. 6A and 6B are diagrams describing an action of a third embodiment.

FIGS. 6A and 6B are diagrams describing an automatic scanning action at the time of presetting a channel in a third embodiment of the invention. In the present embodiment, before automatic scanning is executed, the most direction of receivable directions detected in the past is examined and the automatic scanning is started using its direction as an initial point. FIG. 6A shows an example of a channel presetting table recorded in the memory 8. Here, on channels 3, 8 and 10, a direction 9 is detected as the receivable direction and the direction 9 is the most direction of the receivable directions, so that as shown in FIG. 6B, automatic scanning is started using the direction 9 as an initial point and therefrom, seek processing is performed while sequentially scanning in order of 9→10→11→12→ . . . counterclockwise.

In this case, the direction 9 is the most receivable direction and thereby, there is a high probability that the direction 9 and directions near to the direction 9 are also detected as a receivable direction in this channel, so that time necessary to detect the receivable direction is reduced by starting the automatic scanning using the direction 9 as the initial point.

Then, when it is assumed that, for example, a direction 10 is first detected as a receivable direction during execution of this automatic scanning, in a manner similar to the first embodiment, the automatic scanning is stopped at that point in time and automatic scanning of the next channel is started using the most receivable direction as the initial point based on the channel presetting table updated. In like manner below, the procedure described above is repeated until the seek processing for all the channels is completed.

Figure 7:
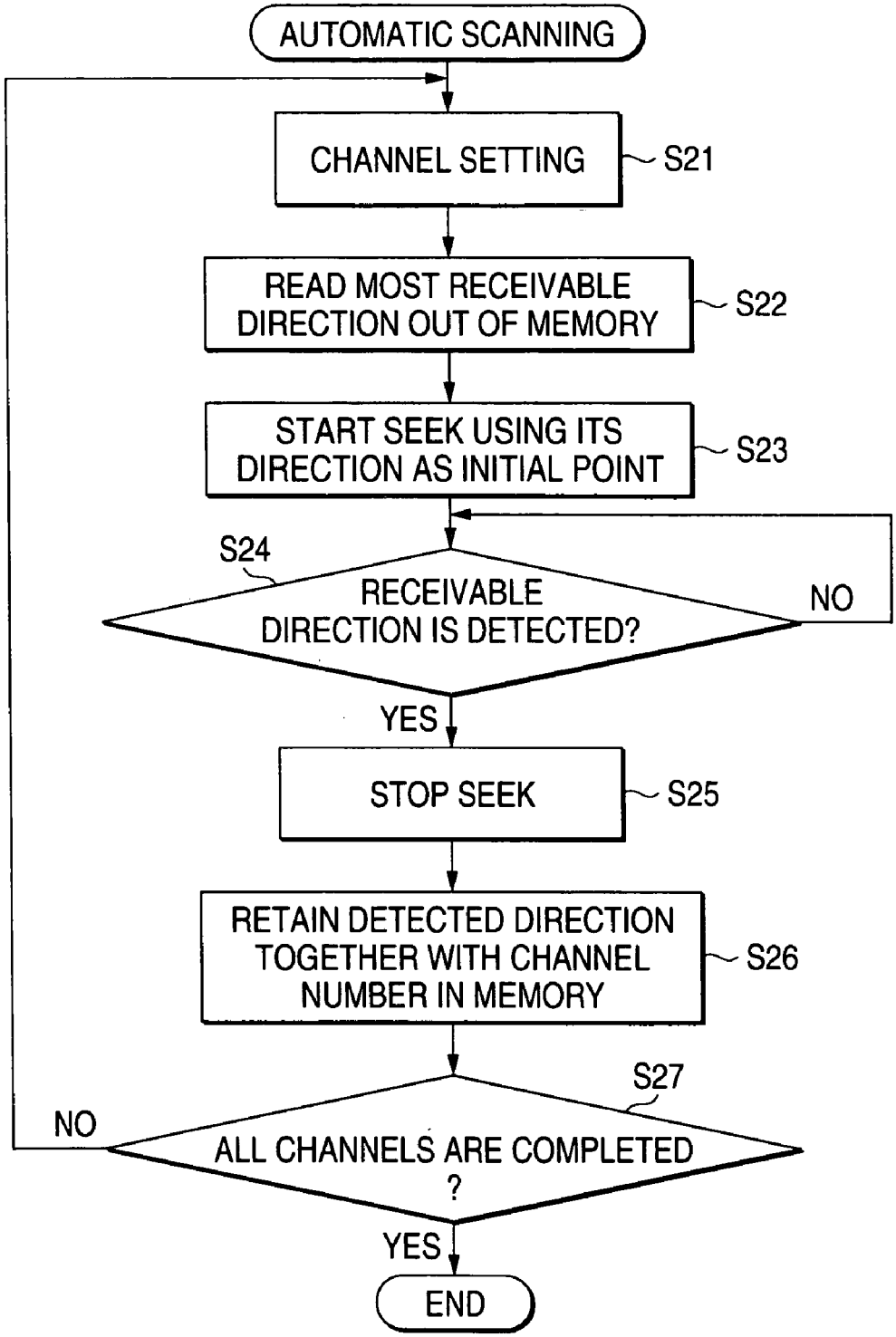
FIG. 7 is a flowchart representing the action of the third embodiment.

FIG. 7 is a flowchart representing the automatic scanning action in the third embodiment. When automatic scanning is started, the control unit 4 makes the smart antenna 2 do setting for a channel searched first (step S21). This detail has been described in step S1 of FIG. 3. Subsequently, the control unit 4 reads out the most receivable direction with reference to the memory 8 (step S22). With respect to the first channel, the past data is not present, so that a direction 0 is read out. The control unit 4 sends a control signal for instructing the smart antenna 2 to sequentially switch directivity counterclockwise from the direction read out to the smart antenna 2 in a predetermined cycle and after receiving this control signal, the smart antenna 2 starts seek processing using its direction as an initial point (step S23).

An action after the seek processing is started is similar to that of the case of FIG. 3. That is, the control unit 4 determines whether or not a receivable direction is detected (step S24), and when the receivable direction is not detected (step S24: NO), the seek processing is continued. When the receivable direction is first detected (step S24: YES), at that point in time, the control unit 4 breaks the automatic scanning and stops the seek processing (step S25). Then, a number of the direction detected at this time is retained in the memory 8 together with a channel number (step S26). Thereafter, it is determined whether or not presettings for all the channels are completed (step S27), and when they are not completed (step S27: NO), the flowchart returns to step S21 and after setting for the next channel is done, the steps S22 to S26 described above are executed and presetting for the next channel is done. When the presettings for all the channels are completed (step S27: YES), the action of automatic scanning is ended.

According to the third embodiment described above, automatic scanning is started from a direction with a high probability capable of reception, so that time necessary to find the receivable direction can further be reduced to achieve a still more speedup in the automatic scanning.

Figures 8A, 8B:
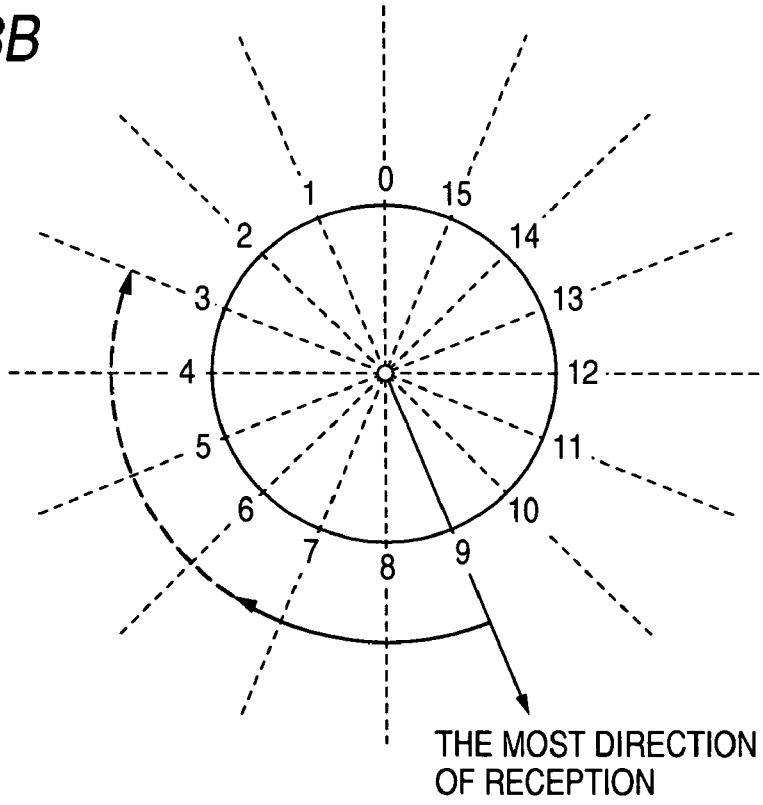
FIGS. 8A and 8B are diagrams describing an action of a fourth embodiment.

FIGS. 8A and 8B are diagrams describing an automatic scanning action at the time of presetting a channel in a fourth embodiment of the invention. In the present embodiment, in addition to examining the most direction of receivable directions detected in the past as shown in the third embodiment, it is examined whether there are more receivable directions in either clockwise direction or counterclockwise direction with respect to its direction and a scanning direction is decided and automatic scanning is started in the scanning direction using the most direction as an initial point.

FIG. 8A shows an example of a channel presetting table recorded in the memory 8. Here, on channels 3, 8 and 10, a direction 9 is detected as the receivable direction and the direction 9 is the most direction of the receivable directions, so that automatic scanning is started using the direction 9 as an initial point. Also, when moving in a direction 1 opposite to the direction 9 in the case of using the direction 9 as the initial point, two directions of a direction 7 (Channel 2) and a direction 5 (Channel 6) are in a state of the receivable direction in a clockwise direction, but only a direction 13 (Channel 12) is in a state of the receivable direction in a counterclockwise direction. Therefore, a scanning direction is decided in the clockwise direction and as shown in FIG. 8B, using the direction 9 as an initial point and therefrom, seek processing is performed while sequentially scanning in order of 9→8→7→6→ . . . clockwise.

In this case, the direction 9 is the most receivable direction and thereby, there is a high probability that the direction 9 and directions near to the direction 9 are also detected as a receivable direction in this channel and also clockwise scanning has a higher probability of detecting the receivable direction than counterclockwise scanning, so that time necessary to detect the receivable direction is reduced by starting the automatic scanning clockwise using the direction 9 as the initial point.

Then, when it is assumed that, for example, a direction 7 is first detected as a receivable direction during execution of this automatic scanning, in a manner similar to the first embodiment, the automatic scanning is stopped at that point in time and automatic scanning of the next channel is started in a rotational direction with many receivable directions using the most receivable direction as the initial point based on the channel presetting table updated. In like manner below, the procedure described above is repeated until the seek processing for all the channels is completed.

Figure 9:
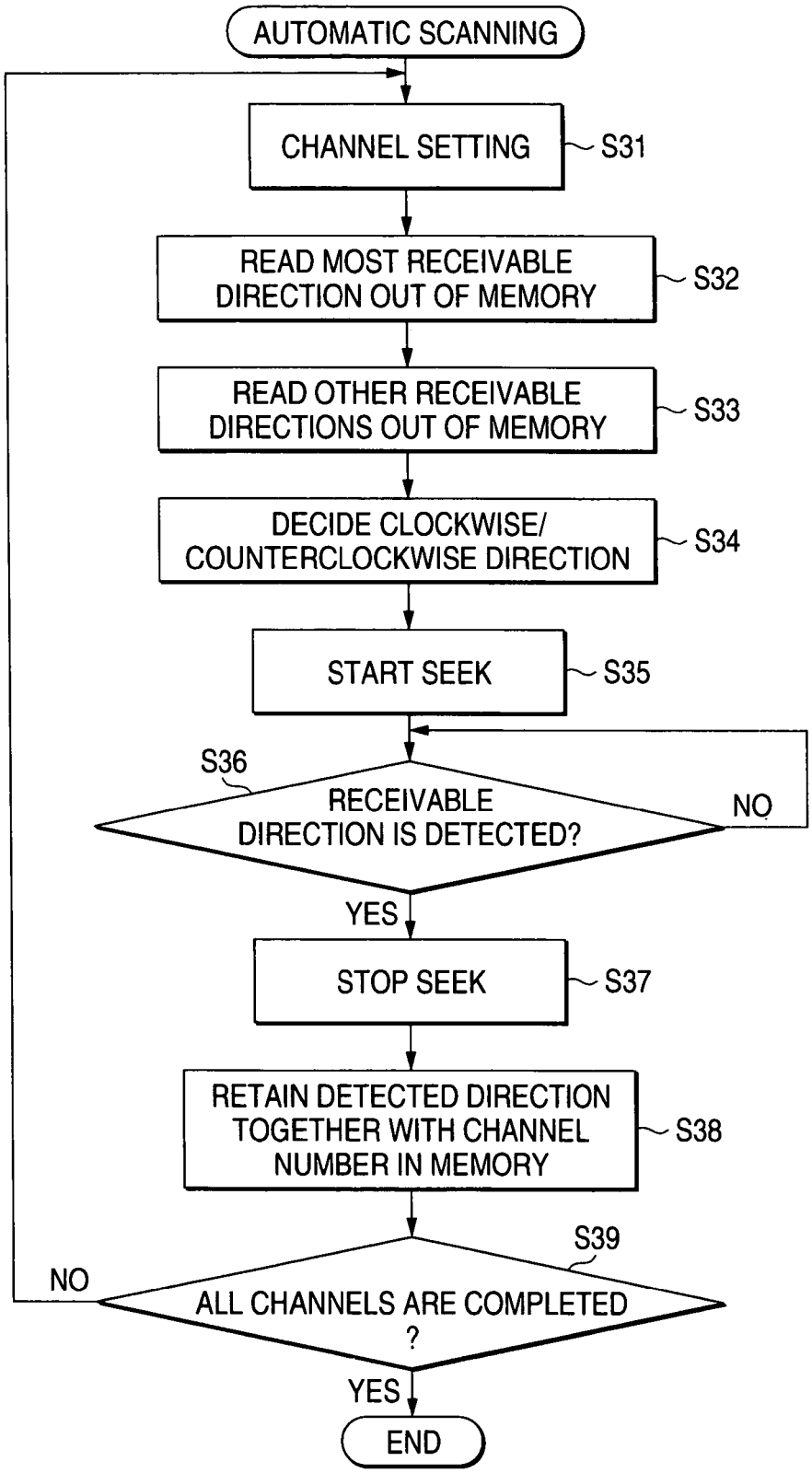
FIG. 9 is a flowchart representing the action of the fourth embodiment.

FIG. 9 is a flowchart representing the automatic scanning action in the fourth embodiment. When automatic scanning is started, the control unit 4 makes the smart antenna 2 do setting for a channel searched first (step S31). This detail has been described in step S1 of FIG. 3. Subsequently, the control unit 4 reads out the most receivable direction with reference to the memory 8 (step S32). With respect to the first channel, the past data is not present, so that a direction 0 is read out. Next, other receivable directions are read out of the memory 8 (step S33). Then, it is decided whether a rotational direction of the automatic scanning is set in a clockwise direction or a counterclockwise direction based on the directions read out in steps S32 and S33 (step S34). With respect to the first channel, it is decided that the counterclockwise direction is a scanning direction. The control unit 4 sends a control signal for instructing the smart antenna 2 to sequentially switch directivity in the rotational direction decided in step S34 using the direction read out in step S32 as the initial point to the smart antenna 2 in a predetermined cycle. After receiving this control signal, the smart antenna 2 starts seek processing in the predetermined rotational direction using the predetermined direction as the initial point (step S35).

An action after the seek processing is started is similar to that of the case of FIG. 3. That is, the control unit 4 determines whether or not a receivable direction is detected (step S36), and when the receivable direction is not detected (step S36: NO), the seek processing is continued. When the receivable direction is first detected (step S36: YES), at that point in time, the control unit 4 breaks the automatic scanning and stops the seek processing (step S37). Then, a number of the direction detected at this time is retained in the memory 8 together with a channel number (step S38). Thereafter, it is determined whether or not presettings for all the channels are completed (step S39), and when they are not completed (step S39: NO), the flowchart returns to step S31 and after setting for the next channel is done, the steps S32 to S38 described above are executed and presetting for the next channel is done. When the presettings for all the channels are completed (step S39: YES), the action of automatic scanning is ended.

According to the fourth embodiment described above, automatic scanning is started from a direction with a high probability capable of reception and the scanning is performed in a direction with a high probability capable of reception, so that time necessary to find the receivable direction can further be reduced to achieve a still more speedup in the automatic scanning.

Figures 10A, 10B:
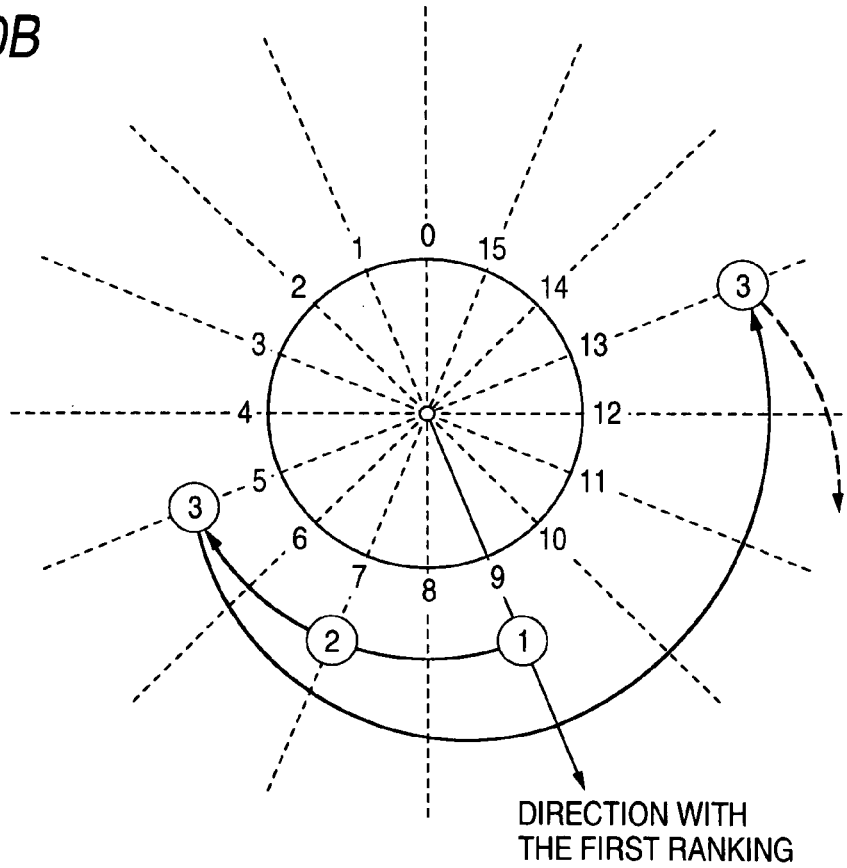
FIGS. 10A and 10B are diagrams describing an action of a fifth embodiment.

FIGS. 10A and 10B are diagrams describing an automatic scanning action at the time of presetting a channel in a fifth embodiment of the invention. In the present embodiment, before automatic scanning for a certain channel is executed, receivable directions detected in the past are ranked according to detection frequency and the automatic scanning is started using the direction with the first ranking as an initial point and the automatic scanning is subsequently executed in a predetermined direction according to the ranked order.

FIG. 10A shows an example of a channel presetting table recorded in the memory 8. Here, on channels 3, 8 and 10, a direction 9 is detected as the receivable direction and the direction 9 is ranked in the first place. Also, on channels 2 and 12, a direction 7 is detected as the receivable direction and the direction 7 is ranked in the second place. Also, on channel 6, a direction 13 is detected as the receivable direction and on channel 13, a direction 5 is detected as the receivable direction, so that the direction 5 and the direction 13 are ranked in the third place.

Therefore, as shown in FIG. 10B, automatic scanning is started using the direction 9 with the first ranking as an initial point and next to the direction 9, the automatic scanning is skipped in the direction 7 with the second ranking and next to the direction 7, it is skipped in the direction 5 with the third ranking and then it is skipped in the direction 13 with the third ranking similarly and in this manner, seek processing is performed while sequentially scanning according to the ranked order. Incidentally, both of the direction 5 and the direction 13 are ranked in the third place, so that next to the direction is 7, the automatic scanning may be skipped in the direction 13 and then may be skipped in the direction 5.

In this case, the direction 9 has the first-ranking detection frequency and thereby, there is the highest probability that the direction 9 and directions near to the direction 9 are also detected as a receivable direction in this channel and the direction 7 with the second ranking has the second highest probability, so that time necessary to detect the receivable direction is reduced by starting the automatic scanning using the direction 9 as the initial point and subsequently performing the scanning according to the ranking.

Then, when it is assumed that, for example, a direction 7 is first detected as a receivable direction during execution of this automatic scanning, in a manner similar to the first embodiment, the automatic scanning is stopped at that point in time and automatic scanning of the next channel is executed according to the ranking described above based on the channel presetting table updated. In like manner below, the procedure described above is repeated until the seek processing for all the channels is completed.

Figure 11:
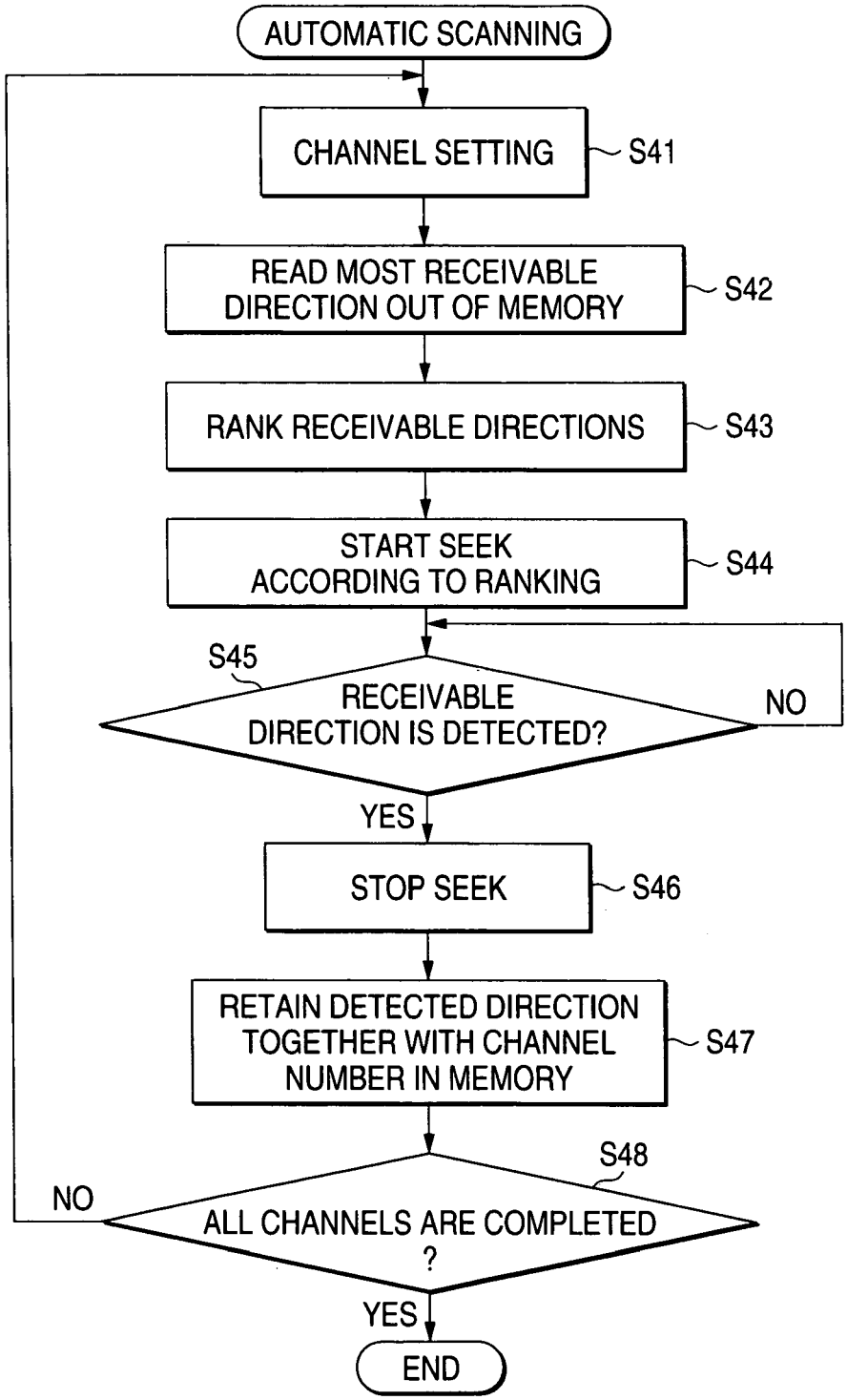
FIG. 11 is a flowchart representing the action of the fifth embodiment.

FIG. 11 is a flowchart representing the automatic scanning action in the fifth embodiment. When automatic scanning is started, the control unit 4 makes the smart antenna 2 do setting for a channel searched first (step S41). This detail has been described in step S1 of FIG. 3. Subsequently, the control unit 4 reads out receivable directions with reference to the memory 8 (step S42). Then, the receivable directions read out are ranked (step S43). Thereafter, seek processing is performed according to the ranking (step S44). With respect to the first channel, the past data is not present, so that the seek processing is performed while sequentially scanning counterclockwise using a direction 0 as an initial point.

An action after the seek processing is started is similar to that of the case of FIG. 3. That is, the control unit 4 determines whether or not a receivable direction is detected (step S45), and when the receivable direction is not detected (step S45: NO), the seek processing is continued. When the receivable direction is first detected (step S45; YES), at that point in time, the control unit 4 breaks the automatic scanning and stops the seek processing (step S46). Then, a number of the direction detected at this time is retained in the memory 8 together with a channel number (step S47). Thereafter, it is determined whether or not presettings for all the channels are completed (step S48), and when they are not completed (step S48; NO), the flowchart returns to step S41 and after setting for the next channel is done, the steps S42 to S47 described above are executed and presetting for the next channel is done. When the presettings for all the channels are completed (step S48: YES), the action of automatic scanning is ended.

According to the fifth embodiment described above, automatic scanning is performed in each of the directions in order of higher probability capable of reception, so that time necessary to find the receivable direction can further be reduced to achieve a still more speedup in the automatic scanning.

In the embodiments described above, the case of applying the invention to the broadcast receiver 1 to which the smart antenna 2 is connected has been taken as an example, but in addition to the smart antenna, the invention can be applied to a broadcast receiver to which an antenna capable of switching directivity in plural directions, for example, an adaptive array antenna is connected. Also, the invention can be applied to, for example, a broadcast receiver for receiving radio broadcasting or a broadcast receiver for receiving satellite broadcasting.

What is claimed is:

1. A broadcast receiver comprising:

a smart antenna which is configured to receive airwaves comprising a plurality of channels;

a tuner which is configured to extract an extracted signal of each of the plurality of channels;

a signal processing unit which is configured to process the extracted signal; and a control unit which is configured to control an antenna direction of the smart antenna, wherein the control unit performs an automatic scanning of at least one of a plurality of antenna directions to detect a receivable antenna direction for at least one of the plurality of channels, the receivable antenna direction being defined as a direction where a power level of the signal of the at least one of the plurality of channels is above a threshold value, wherein the control unit ranks a plurality of antenna directions according to frequency of detection as the receivable antenna direction in past automatic scanning, and the control unit first scans the first ranked antenna direction in the plurality of the antenna directions, and subsequently scans the other antenna directions in descending order of frequency during the automatic scanning for the at least one of the plurality of channels, and wherein when the receivable antenna direction for one of the plurality of channels is detected during execution of an automatic scanning for the one of the plurality of channels, the automatic scanning for the one of the plurality of channels is stopped and an automatic scanning for another of the plurality of channels is started.

* * * * *